US005149312A

United States Patent [19]

Croft et al.

[11] Patent Number: 5,149,312

[45] Date of Patent: Sep. 22, 1992

[54] QUICK DISCONNECT LINKAGE FOR EXERCISE APPARATUS

[75] Inventors: Harold B. Croft, Logan; Ken C. Jones, Hyde Park, both of Utah

[73] Assignee: Proform Fitness Products, Inc., Logan, Utah

[21] Appl. No.: 658,307

[22] Filed: Feb. 20, 1991

[51] Int. Cl.[5] ..... A63B 22/12; A63B 69/16

[52] U.S. Cl. ..... 482/62; 482/148

[58] Field of Search ..... 482/35, 36, 37, 23, 482/62, 70, 148

[56] References Cited

U.S. PATENT DOCUMENTS 4,188,030 2/1980 Hooper .
4,509,742 4/1985 Cones .
4,880,225 11/1989 Lucas et al. .
4,917,376 4/1990 Lo ..... 482/62
4,962,925 10/1990 Chang .
4,971,316 11/1990 Dalebout et al. .
4,981,294 1/1991 Dalebout et al. .

*Primary Examiner*—Stephen R. Crow
*Attorney, Agent, or Firm*—Trask, Britt & Rossa

[57] ABSTRACT

The present invention comprises a quick release apparatus for a link member to drive assembly connection and particularly for a link member driven by a pedal drive of an exercise apparatus and which, in turn, drives a reciprocable member such as a rotatably mounted handlebar stem on the exercise apparatus.

17 Claims, 2 Drawing Sheets

QUICK DISCONNECT LINKAGE FOR EXERCISE APPARATUS

BACKGROUND OF THE INVENTION

1. Field

The present invention relates generally to exercise apparatus and, specifically to stationary exercise cycles having handlebars which are interconnected or linked to the pedal drive of the cycle so that the handlebars are generally reciprocated through movement of the pedal gear assembly. Such cycles may be referred to as "dual action" cycles, in that they provide the user with a simultaneous workout of both upper and lower body muscle groups.

2. State of the Art

Dual action exercise cycles have been in existence for a number of years, and employ a variety of designs. See, for example, U.S. Pat. No. 4,188,030 to Hooper; U.S. Pat. No. 4,509,742 to Cones; U.S. Pat. No. 4,880,225 to Lucas et al.; U.S. Pat. No. 4,962,925 to Chang; U.S. Pat. No. 4,971,316 to Dalebout et al. and U.S. Pat. No. 4,981,294 to Dalebout et al. While many of the cycles disclosed in the foregoing patents employ fairly complex mechanisms to drive the handlebars from the pedal gear assembly, U.S. Pat. No. 4,509,742 to Cones, U.S. Pat. No. 4,880,225 to Lucas et al., and U.S. Pat. No. 4,981,294 to Dalebout et al. drive the handlebars from locations adjacent the pedals.

U.S. Pat. No. 4,981,294 to Dalebout et al., which is assigned to the assignee of the present invention and incorporated herein for all purposes by this reference, is illustrative of the state of the dual action exercise cycle art insofar as the direct crank/handlebar stem linkage design is concerned. While highly effective in providing an energetic reciprocating action to the handlebars in response to rotation of the pedal crank, the design of the '294 patent does not permit disconnection of the handlebar stem drive from the pedal crank and/or reconnection thereto without the use of tools and attendant substantial time and effort, and thus is inconvenient for those desiring to conduct a workout of the lower body only.

U.S. Pat. No. 4,509,742 to Cones discloses the concept of releasing the drive arm or "link rod" from the pedals of the cycle and securing the handlebars through the link rod in a locked position on the cycle frame, but fails to disclose any means for doing so.

SUMMARY OF THE INVENTION

The present invention relates to exercise apparatus having a dual action exercising motion and, in particular, to a simple but elegant means for quickly disconnecting and reconnecting the drive linkage between the drive mechanism and a driven mechanism of the apparatus.

In the present invention, one end of a drive arm or link member is pivotally secured to the lower end of a handlebar stem, which is itself pivotally mounted above the drive arm connection point to the cycle frame. The other end of the drive arm is releasably linked to the pedal crank adjacent the pedal by a quick connect/disconnect or "quick release" apparatus.

The preferred embodiment of the quick release apparatus of the present invention includes a link assembly and a cooperating link member latching and locking aperture which releasably locks into the link assembly. The link assembly includes a pedal shaft which is secured to the pedal crank at a right angle thereto, the pedal shaft section between the pedal and the crank comprising a latching surface of a first diameter and a locking surface of a second, larger diameter. A link guard washer or other spacer means of larger outer diameter than the diameter of the locking surface is slidably mounted on the pedal shaft latching surface, and biased toward the locking surface, abutting the latter under the aforementioned bias, which may comprise a coil spring. The latching and locking aperture preferably includes an entry channel opening on the bottom of the link member and of a width slightly greater than that of the latching surface, and a locking bay above and in communication with the entry passage and of a diameter slightly greater than that of the pedal shaft's locking surface.

In operation, to connect the link member to the link assembly, the spacer is moved away from the locking surface against its spring bias, and the link member entry channel is positioned over the latching surface adjacent the locking surface and dropped thereover until the locking bay surrounds the latching surface. Then, the end of the link member is moved sideways toward the crank along the pedal shaft to encompass the locking surface, and the link guard is released to abut the locking surface and retain the link member on the locking surface. The link member cannot release from the pedal shaft in this position, as the entry channel is too narrow to permit the locking bay to jump off of the locking surface; and the spring-biased guard will not permit accidental lateral movement, although removal of the link members from the pedal shaft is easily effected by the cycle user, who can merely press the spacer away from the locking surface, move the link member along the shaft away from the crank until it is aligned with the latching surface, and then lift the lift arm. An additional feature of the present invention is a locking notch on the top edge of the linking member, which can be swung to the reverse orientation of its normal position; the notch may then be engaged with a locking stud on the cycle frame to render the handlebar stem, and thus the handlebar, immobile.

It should be understood, while only a single pedal shaft and link member have been discussed with respect to the quick release mechanism, that there are generally two pedal shafts and two cooperating link members, each driving a separate element, such as a handlebar stem, which in turn reciprocates and moves the handlebars of the cycle.

An alterative embodiment of the present invention includes a link member having an entry channel and locking bay at the pedal shaft end thereof, which it latches over; but, in lieu of a spring-biased shaft-mounted retention mechanism, a locking slide having an extension or nose thereon which is reciprocally mounted on the linking member prevents the link member from jumping off of the shaft. The locking slide may be used with a pedal shaft having adjacent latching and locking surfaces as in the preferred embodiment, and slide under the latching surface to effectively close the link member entry channel, or have a fork-shaped mouth at the locking end thereof to move over and under the latching surface. Alternatively, the pedal shaft may include only a single locking surface, which is accommodated by the entry channel, the locking slide nose then moving toward the pedal shaft and under the latching surface, thereby closing off the entry channel and preventing removal of the link member from the shaft. The locking slide may be spring-biased toward the pedal shaft, may lock in a notch on the edge of the link member, or may be split along its longitudinal dimension at the pedal shaft end so as to accommodate some torsional upward flex of the shaft end of the slide; this permits a tooth extending downwardly from the upper end of the mouth to move up and over the latching surface, and then down again, the tooth preventing the locking slide from moving away from the pedal shaft and releasing the link member.

DETAILED DESCRIPTION OF THE PREFERRED EMBODIMENTS OF THE INVENTION

The present invention will be readily appreciated and fully understood by reference to the drawings attached hereto as read in conjunction with the following description of the structure and operation thereof.

Figure 1:
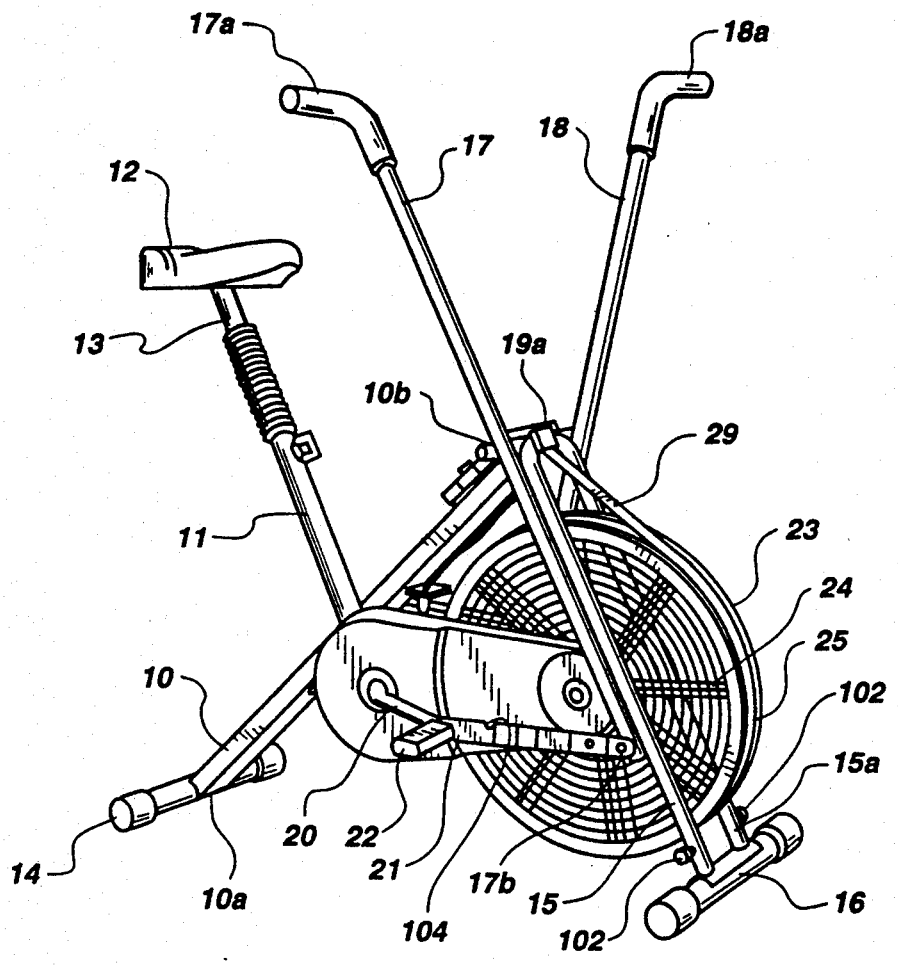
FIG. 1 is a perspective view of an exercise cycle in which the present invention is employed.

FIG. 1 is a perspective view of a dual action exercise cycle which has a main frame member 10 and a seat column 11 attached to the main frame member 10 to support a seat 12 attached to an adjustable seat post 13. The lower end 10*a* of the main frame member 10 is attached to a transverse foot bar 14 which forms one support member for supporting the exercise cycle in an upright position. At the forward end 10*b* of the main frame member an inverted "U"-shaped front support (fork) 15 is attached, which in conjunction with front foot bar 16, attached to the lower end 15*a* of the front support member 15, supports the forward portion of the exercise cycle.

A pair of elongated handlebar stems 17 and 18 are rotatably attached proximate their midpoints to a transverse member 19 attached to the main frame member 10 near its forward end. The elongated handlebar stems have handle portions 17*a* and 18*a* protruding laterally therefrom and are each pivotally interconnected proximate their lower ends with a cooperating pedal crank 20 (only one shown) by an arm or link member 21 which is also rotatably attached to the pedal shaft 32 (see FIG. 2) between the crank 20 and the pedal 22. Link members 21 are pivotally attached to stems 17 and 18 via pin members passing through the lower ends 17*b* and 18*b* (not shown) thereof to create an interconnection between each crank 20 and a handlebar stem 17 or 18 so that as the cranks 20 are rotated, the handlebar stems 17 and 18 reciprocate, i.e. both upper and lower ends move backward and forward in a reciprocating motion. The reciprocation of the one handlebar stem to the other is 180° out of phase, i.e. as the top one handlebar stem moves forward, the top of the other handlebar stem moves to the rear. The front wheel 23 is rotatably attached at its hub to an axle attached to the fork member 15.

The wheel 23 has blade members 24 which have wide faces positioned transverse to the rim 24 of the wheel. The blade members may have a thicker portion along the longitudinal axis to assist the blade members in acting as spokes radially attached to the central hub and to the rim. The blade members are preferably equally distantly spaced about the inner circumference of the rim of the wheel 23.

An adjustable friction strap member 29 is secured at one end to the front end 10*a* of the frame member 10. The strap encircles a significant portion of the rim 25 of the front wheel with its other end adjustably attached to frame member 10 at a point above the pedal cranks.

In operation, the user's feet propel the pedals of the exercise cycle, which, through cranks 20 attached to a drive sprocket (not shown), drive a continuous chain interacting with a driver sprocket connected to the hub of the front wheel. Thus, while wheel 23 is rotated by pedal cranks 20, handlebar stems 17 and 18 are reciprocated at the same time. However, via the quick release mechanism of the present invention, link members 21 may be easily disconnected from pedal shaft 32 for a lower body only exercise, and then reconnected for a combined upper and lower body workout.

Figure 2:
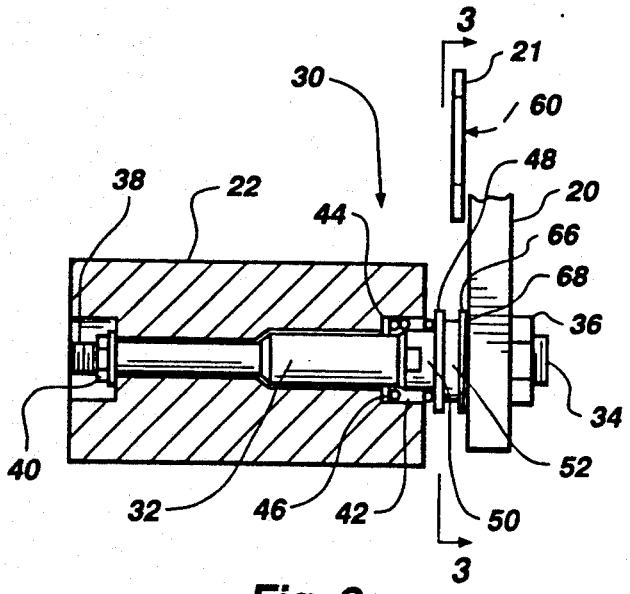
FIG. 2 is an enlarged partial section of the quick release apparatus of the present invention as applied to the exercise cycle of FIG. 1.
Figure 3:
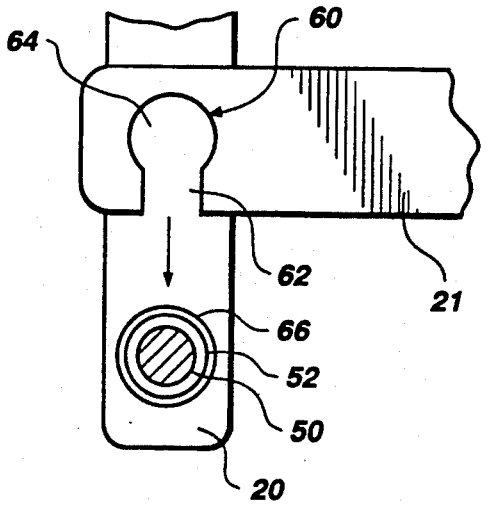
FIG. 3 is a sectional view of the quick release apparatus of the present invention taken across section lines 3—3 of FIG. 2.

Referring now to FIGS. 2 and 3 of the drawings, pedal shaft 32 is secured at its inner end 34 to the end of crank 20 at a right angle thereto via nut 36, while the outer end 38 thereof is surrounded by lock nut 40, which keeps pedal 22 from slipping off the shaft 32. The inner end of pedal 22 includes pedal cavity 42, which receives spring stop 44 (preferably a washer) and coil spring 46, which biases link guard 48 toward crank 20. The movement of link guard 48 toward crank 20 is arrested by locking surface 52, which is substantially coaxial with and of larger diameter than latching surface 50 but smaller than the outer diameter of link guard 48. Link member 21 is oriented generally at a right angle to pedal shaft 32 and includes, at the end proximate crank 20, a latching and locking aperture 60 comprising an entry channel 62 of slightly greater width than the diameter of latching surface 50, channel 62 opening into the bottom edge of link member 21, and into circular locking bay 64 thereabove, locking bay 64 being of slightly greater diameter than that of locking surface 52.

To connect link member 21 to crank 20, entry channel 62 is positioned over latching surface 50 and link guard 48 is moved toward pedal 22 against the bias of spring 46, providing sufficient clearance for link member 21 to drop down between link guard 48 and locking surface 52 and over latching surface 50. Link member 21 is then dropped or otherwise moved down over latching surface 50 until the latter is surrounded by locking bay 64, at which point link member 21 is moved toward crank 20, assisted by spring 46 and limb guard 48, over locking surface 52, where it rests against bushing 66 adjacent washer 68 abutting crank 20. Link member 21 is thus firmly locked over pedal shaft 32 on locking surface 52, and the user may then rotate pedals 22 and cranks 20 without fear that link members 21 will jump off the pedal shafts during vigorous rotational movement thereof. This results from the force of the rotating pedal shafts being directed substantially along the longitudinal axis of the link members, locking bays 64 firmly surrounding locking surfaces 52. Off-longitudinal forces are negligible, and in any event are precluded from moving link members 21 off of locking surfaces 52 by link guards 4 and the bias of springs 46.

Figure 4:
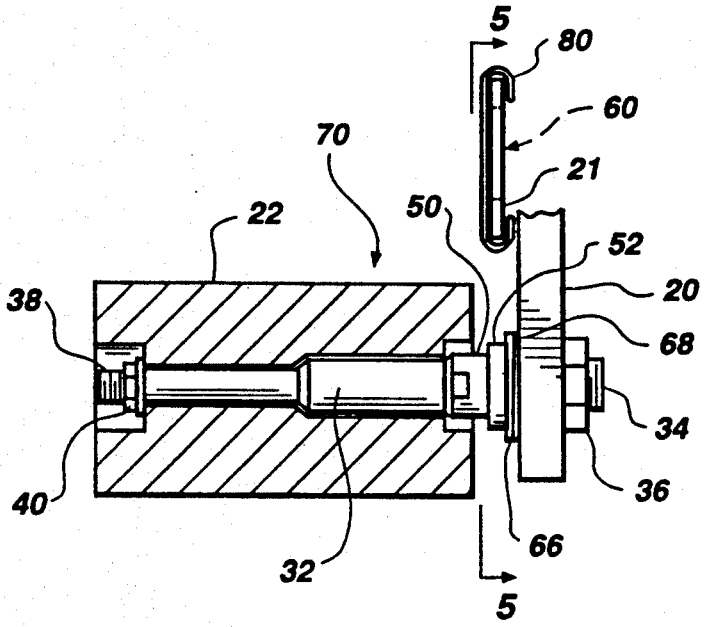
FIG. 4 is an enlarged partial section view of alternative embodiments of the present invention.
Figure 5:
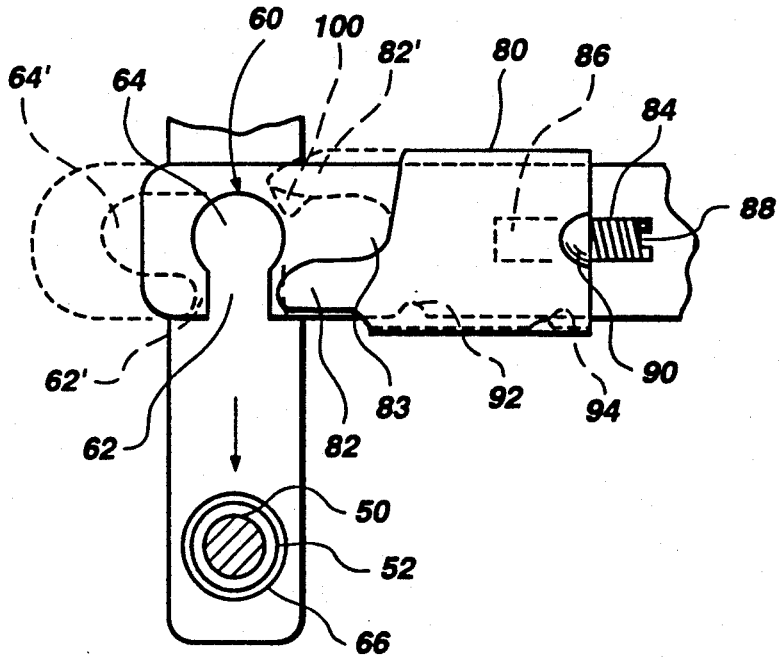
FIG. 5 is a sectional view of the embodiment of FIG. 4 taken across section lines 5—5.

Referring now to FIGS. 4 and 5 of the drawings, an alternative embodiment of the present invention utilizes a link assembly 70 very similar to that of the preferred embodiment 30, but without a link guard, spring stop or spring. Otherwise, the parts of the assembly are the same, and have been numbered with like numerals. The link member 21 is provided with a latching and locking aperture 60 comprising an entry channel 62 and locking bay 64, the dimensions thereof being respectively related to those of latching surface 50 and locking surface 52 of assembly 70 in the same manner as in the preferred embodiment of the invention. However, link member 21 in this embodiment includes locking slide 80, which is longitudinally reciprocably mounted on link member 21, and which includes one or more extensions or noses 82 and 82', but at least one such nose 82 at the level of entry channel 62. In the event two extensions are employed, they define mouth 83 which encompasses latching surface 50 when slide 80 is advanced toward the end of link member 21. Locking slide 80 may be springbiased toward a position closing off entry channel 62 with spring 84 in slot 86 of link member 21 supported at one end on stud 88 and enclosed at the other in dimples 90 in slide 80.

Alternatively, slide 80 can employ a spring detent system to lock it in place over entry channel 62. For example, as shown in FIG. 5, notch 92 can be placed in the bottom edge of link member 21, and the lower edge of locking slide 80 may be stamped and a portion bent inward into a leaf spring 94, which prevents unrestricted movement of slide 80 on link member 21 and pops into notch 92 when slide 80 advances to close entry channel 62. As a further alternative, a tooth 100 may be added to upper extension 82', and the top of slide 82 split back to the main body of the slide, so as to provide the ability for extension 82' to flex upwardly and over latching surface 50, then downwardly again to hold slide 80 in its advanced position. Moreover, the latching surface 50 may be eliminated, and the mouth 83 sized to accommodate locking surface 50. Of course, entry channel 62 would have to be dimensioned as shown at 62' to accommodate locking surface 50, and it would be preferable in such an embodiment to have longitudinally elongated locking by 64' to permit pedal shaft 32 to lie in the portion of the locking bay removed from the entry channel to provide additional strength via the linking member material against downwardly directed crank forces. Locking slide 80 could then be maintained in its advanced position by any of the previously disclosed means.

In operation, the alternative embodiments, with the exception of the last-mentioned one above without a latching surface, provide for attachment of the link members to the pedal shaft in the same manner as the preferred embodiment, and retain it thereon via a locking slide instead of a link guard. In the last disclosed embodiment of the invention, the link member is placed over the locking surface of the pedal shaft, which enters locking bay 64, after which slide 80 is advanced to maintain link member 21 on locking surface 52.

Another notable feature of the present invention resides in a means to lock handlebar stems 17 and 18 in a stationary position after link members 21 are released from the pedal shafts 32. Such a means comprises headed studs 102, which are attached to the outboard sides of the lower ends 15*a* of the front support member 15, and a cooperating notch 104 on the upper edge of each link member 21. To effect the aforementioned stem locking, disconnected link members 21 are rotated about pins 17*b*, and notches 104 engage the shanks of studs 102, the heads thereof preventing lateral slippage of the link members 21 off of studs 102.

While the invention has been disclosed in terms of a plurality of embodiments, it is not so limited, and it will be appreciated by those skilled in the art, that many additions, deletions and modifications may be made to the disclosed embodiments without departing from the spirit and scope of the invention as claimed. For example, a belleville spring or a rubber spring may be employed to bias the link guard on the locking slide, a spring-biased ball detent could be employed to lock the locking slide in its closed, and open, positions, and others.

We claim:

1. An exercise cycle having link members operatively connecting respective handlebars to pedal shafts, comprising:

a locking surface of a first diameter disposed on said respective pedal shafts adjacent a substantially coaxial latching surface of a second, smaller diameter;

a latching and locking aperture in each of said link members, said aperture comprising an entry channel of a width larger than the diameter of said latching surface and smaller than that of said locking surface, said entry channel extending from the bottom end of said link member upwardly to communicate with an entry bay of greater dimension than the diameter of said locking surface; and means for retaining said locking bay on said locking surface when each said link member is connected to said pedal shaft.

2. The apparatus of claim 1, wherein said retaining means comprises a guard on each said pedal shaft resiliently biased toward said locking surface.

3. The apparatus of claim 1, wherein said retention means comprises a locking slide associated with said link member and adapted to selectively extend across said entry bay.

4. The apparatus of claim 1, wherein said retaining means comprises a guard resiliently biased across said latching surface toward said locking surface.

5. The apparatus of claim 4, wherein said retaining means comprises a washer-shaped spacer disposed about said latching surface, and resiliently biased by a coil spring disposed about said shaft.

6. The apparatus of claim 1, wherein said retaining means comprises a locking slide slidably disposed on said link member adjacent said latching and locking aperture and including at least one extension adapted to protrude across said entry bay upon movement of said slide toward said aperture.

7. The apparatus of claim 6, wherein said locking slide is biased toward said aperture.

8. The apparatus of claim 6, wherein said locking slide- includes a spring adapted to engage a notch on said link member when said extension protrudes across said aperture to resiliently maintain said slide in position.

9. The apparatus of claim 6, wherein said locking slide includes a first and a second extension defining a mouth facing toward said aperture.

10. The apparatus of claim 9, wherein one of said extensions includes a tooth thereon extending into said mouth.

11. The apparatus of claim 10, wherein said one extension is adapted to flex away from said shaft upon contact of said tooth therewith.

12. The apparatus of claim 1, further including a notch on each said link member adapted to cooperate with a stud on said exercise cycle when placed thereover to maintain said link member, and thereby each said handlebar, in a fixed position.

13. An exercise cycle having link members operatively correcting respective handlebars to pedal shafts, comprising:

a latching surface disposed on each of said pedal shafts, a latching aperture in said link member for receiving said latching surface, said latching aperture comprising a bay sized to accommodate said latching surface, said bay including a mouth extending upwardly from the bottom edge of said link member; and means for retaining said latching surface within said latching aperture when each said link member is connected to said pedal shaft, 14. The apparatus of claim 13, wherein said retention means comprises a slide disposed on said link member.

15. The apparatus of claim 14, wherein said slide is adapted to selectively extend across said bay mouth below said latching surface when said latching surface is received in said latching aperture.

16. The apparatus of claim 15, wherein said slide includes at least one extension adapted to selectively extend across the mouth of said bay responsive to movement of said slide toward said latching aperture.

17. The apparatus of claim 13, further including means for locking said retaining means in position to retain said latching surface within said latching aperture.

* * * * *

UNITED STATES PATENT AND TRADEMARK OFFICE

CERTIFICATE OF CORRECTION

PATENT NO. : 5,149,312

DATED : September 22, 1992

INVENTOR(S) : Croft, et al.

It is certified that error appears in the above-identified patent and that said Letters Patent is hereby corrected as shown below:

On the title page: Item [56]

U.S. Patent 4,723,786 02/1988 Buchanan.

Col. 7, line 2 (claim 13)

change "correcting" to -- connecting --.

Signed and Sealed this

Sixteenth Day of February, 1993

*Attest:*

STEPHEN G. KUNIN

*Attesting Officer*

*Acting Commissioner of Patents and Trademarks*